United States Patent [19]

Barfield

[11] Patent Number: 4,616,492

[45] Date of Patent: Oct. 14, 1986

[54] KEY COMBINATION LOCK

[76] Inventor: J. David Barfield, 3361 Bagley Ave. #1, Los Angeles, Calif. 90034

[21] Appl. No.: 648,756

[22] Filed: Sep. 7, 1984

[51] Int. Cl.[4] ..... E05B 37/02

[52] U.S. Cl. ..... 70/284; 70/306; 70/316; 70/365; 70/383; 70/385

[58] Field of Search ..... 70/365, 366, 383–385, 70/377, 321, 322, 305, 306, 284, 315, 316

[56] References Cited

U.S. PATENT DOCUMENTS

| | | | |
|---|---|---|---|
| 3,473,356 | 10/1969 | Niilola | 70/360 |
| 4,267,717 | 3/1981 | Martikainen | 70/366 |
| 4,325,240 | 4/1982 | Gable | 70/284 |
| 4,375,159 | 3/1983 | Bechtiger et al. | 70/366 |
| 4,418,555 | 12/1983 | Uyeda | 70/377 X |

FOREIGN PATENT DOCUMENTS

| | | | |
|---|---|---|---|
| 566170 | 11/1923 | France | 70/366 |

*Primary Examiner*—Gary L. Smith
*Assistant Examiner*—Russell W. Illich
*Attorney, Agent, or Firm*—Beehler, Pavitt, Siegemund, Jagger, Martella & Dawes

[57] ABSTRACT

The combination lock is one wherein movable members of the combination mechanism are set in decoding position by a key in the form of a rotatable shaft with a head at one end serving as a handle. Rotation of the key to proper decoding position is determined by shifting an index mark on the key relative to selected units of a set of letters or numerals on the lock housing. The combination mechanism makes use of a multiple number of pairs of discs concealed in the housing which must be successively set in proper decoding position, one disc relative to the other, to release a lock operating plug. In proper decoding position a slide bar, which normally blocks rotation of the lock operating plug, is shifted by key action into openings provided in the discs and out of blocking engagement with the plug, in which position the plug is free for rotation by the key. Should the need arise to change the combination, a key of the same type is made use of to shift the position of one disc of a pair relative to the other disc of that pair so that thereafter the new combination of letters or numbers, as the case may be, must be used to release the operating plug.

20 Claims, 17 Drawing Figures

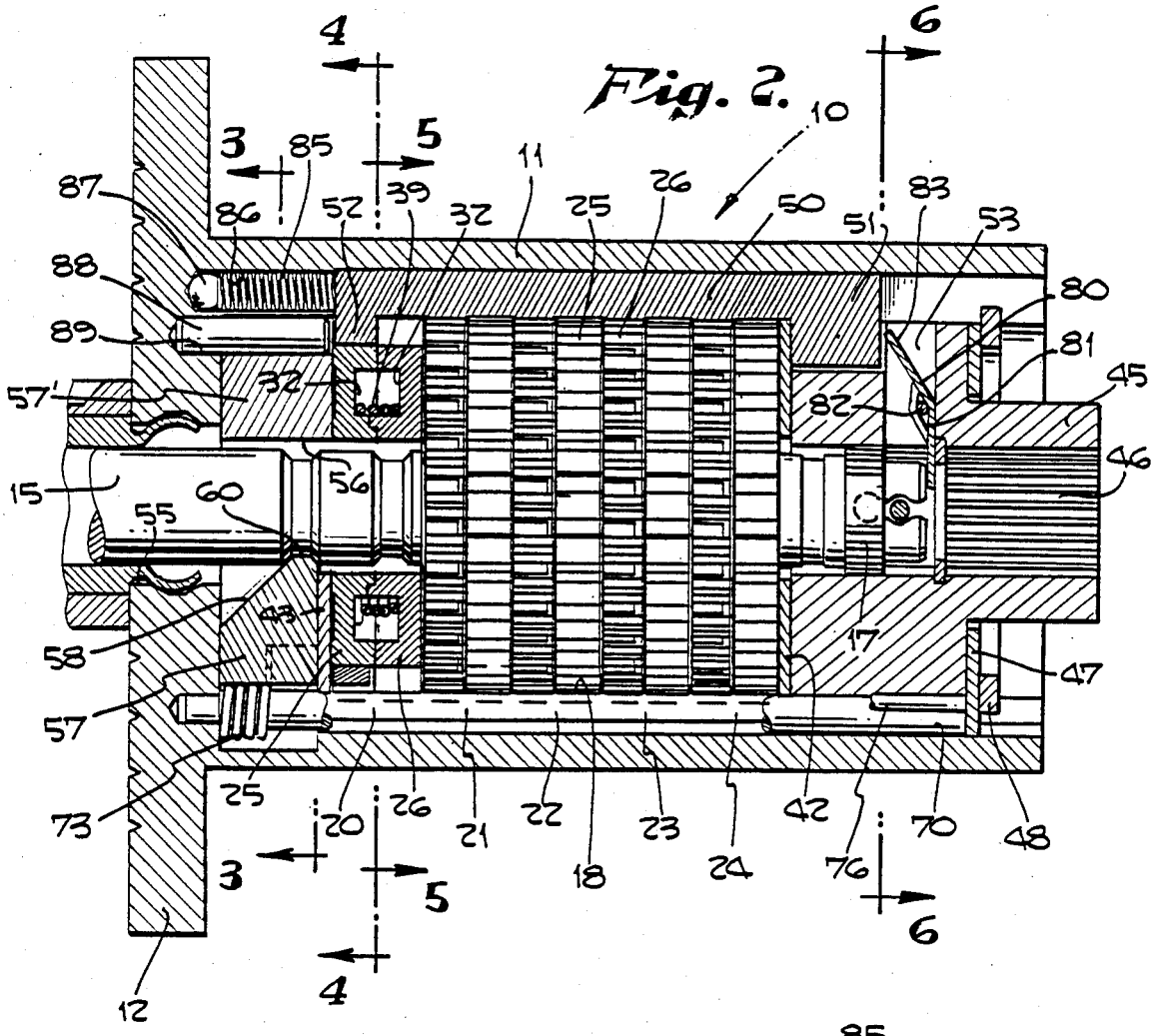
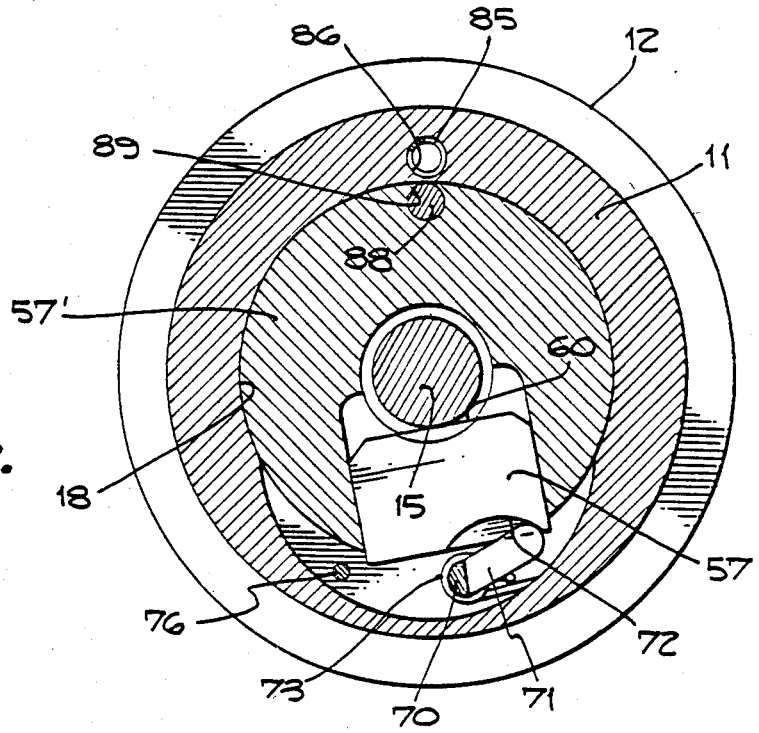
Fig. 3.

KEY COMBINATION LOCK

Combination locks, long in use and wide in variety, continue to be a widely accepted type of security device when the quality of the lock is adjusted to the particular degree of security involved. Relatively inexpensive combination type locks are uniformly acceptable for minimum security uses such, for example, as lockers, cabinets, padlocks and storage facilities, to mention a few. Combination locks of relatively great security are in widely accepted use for installations such, for example, as vaults and safes. The factors providing such high degree of security, however, demand locking mechanisms of a type too costly for more conventional use. Where, as in recent times, the need for security has increased, the need has developed for a lock such as a combination lock in a moderate price range which cannot readily be tampered with by unauthorized persons and which possesses a greater number of combinations than heretofore available.

Normally, combination type locks, whether of the moderate security type or high security type, tend to employ visible indicia of some kind so that the decoding dial or disc, such as may be employed, is readily accessible and visible to the operator. When the combination device is not of the high security type, such visibility may make the device more susceptible to having unauthorized persons solve the decoding combination. Further still, combination type locks, where movable elements of the mechanism are readily visible, are often such that they can be readily damaged, either inadvertently or deliberately, in an attempt to force the lock.

It is therefore among the objects of the invention to provide a new and improved combination type lock capable of an especially high degree of security and of a design such that the combination code cannot be readily solved by unauthorized persons of considerable skill.

Another object of the invention is to provide a new and improved combination type lock of relatively high security character wherein movable parts of the mechanism, together with decoding means, may be concealed from view and lodged within the body of the device.

Another object of the invention is to provide a new and improved combination type lock having relatively high security characteristics which requires employment of a removable key in order to adjust the mechanism to decoding position.

A further object of the invention is to provide a new and improved key type combination lock of a character such that the combination can be readily changed, if needed, by use of a comparable key without the need for any disassembly or demounting of the locking device.

Further included among the objects of the invention is to provide a relatively high security key type combination lock of a construction readily adapted to use with current and conventional lock manufacturers' hardware, whether key in knob, mortise locks, or padlocks, the design being such that relatively few individual parts are needed, thereby providing a lock which is modest in cost.

Also included among the objects of the invention is to provide a relatively inexpensive key combination locking device of such character that it can be built with virtually any number of decoding sequences without adding materially to the cost of construction.

Included also among the objects of the invention is to provide a new and improved key combination lock device having relatively few parts considering the great variety of code combinations available, the parts being of a character readily manufactured with appreciable accuracy and readily assembled into an acceptable locking medium, while at the same time capable of a high degree of security as well as one capable of a relatively quick decoding operation.

With these and other objects in view, the invention consists of the construction, arrangement, and combination of the various parts of the device serving as an example only of one or more embodiments of the invention, whereby the objects contemplated are attained, as hereinafter disclosed in the specification and drawings, and pointed out in the appended claims.

In the drawings:

FIG. 2 is a longitudinal sectional view of the housing with the key in place and one of the pairs of discs in section;

FIG. 3 is a cross-sectional view on the line 3—3 of FIG. 2;

Figure 1:
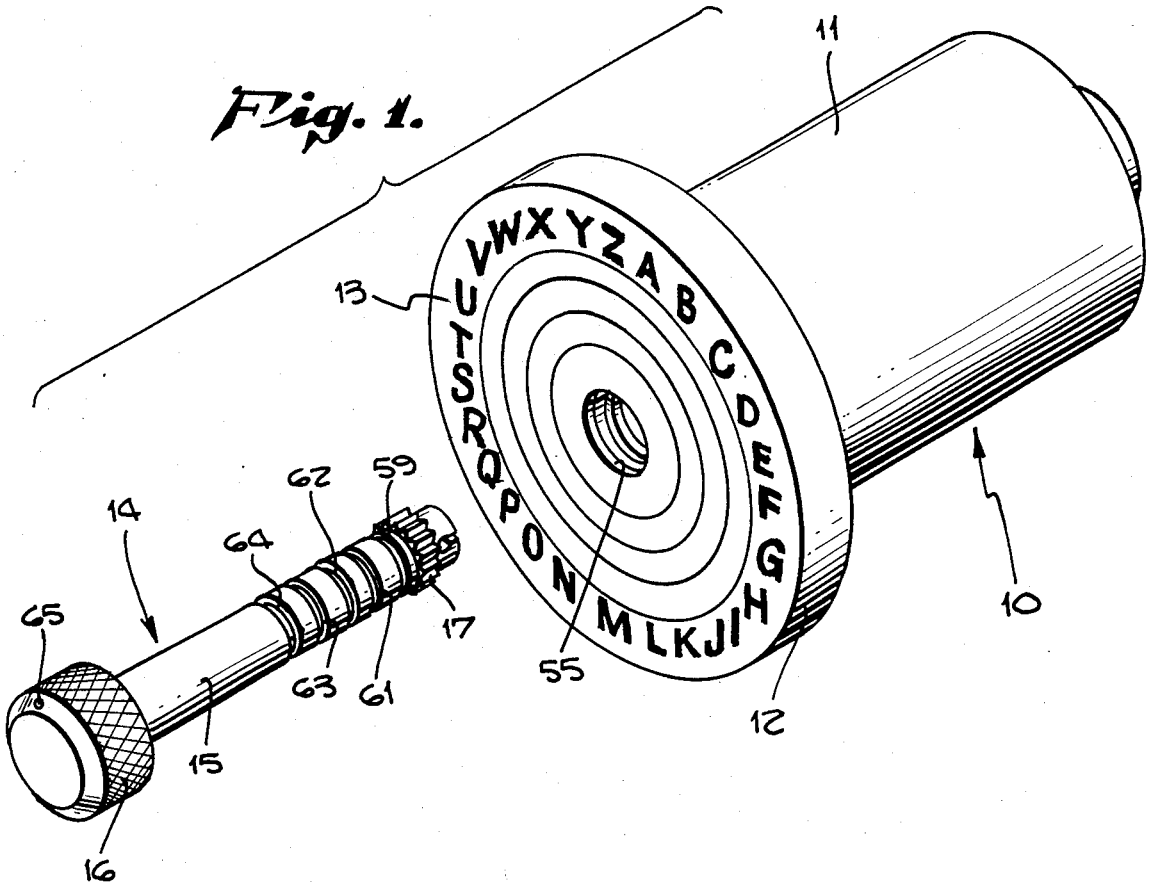
FIG. 1 is a perspective view of the housing and a key ready for insertion and operation with the housing.

In an embodiment of the invention chosen for the purpose of illustration the combination type locking device of the invention is shown as one embodied in a cylindrical housing 10 having a body 11 and a mounting ring 12 at one end on which is carried a set 13 of combination characters here shown as the letters of the alphabet. A key 14 is one consisting of a cylindrical shaft 15, at one end of which is a head 16 knurled and serving as a handle and at the other end of which is a circumferentially serrated collar 17 which serves a double purpose, namely, that of manipulating the combination to decoding position and ultimately operating an appropriate lock mechanism.

In a cylindrical chamber 18 within the body 11 of the housing 10 are located a multiple number of pairs 20, 21, 22, 23 and 24 of lock operating discs, five pairs being used in the chosen embodiment. The arrangement of the lock operating disc is compact with the discs in assembled and operating condition substantially filling the chamber 18.

Each of the pairs of discs is identical and consists of a locking disc 25 and a combination disc 26. The locking disc and combination disc are adapted to rotate relative to each other in the course of a decoding operation.

Figure 4:
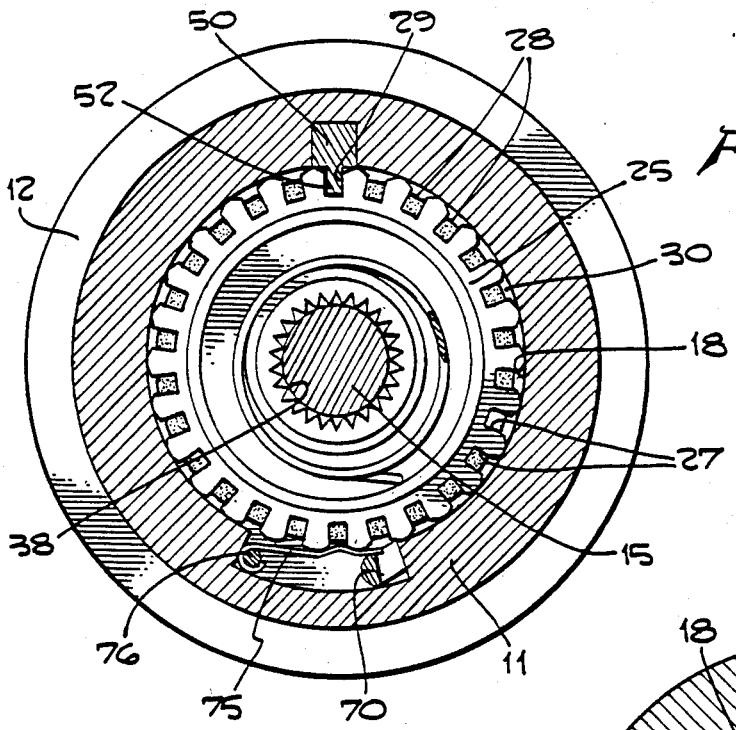
FIG. 4 is a cross-sectional view on the line 4—4 of FIG. 2 in the direction of the arrows 4—4.
Figure 9:
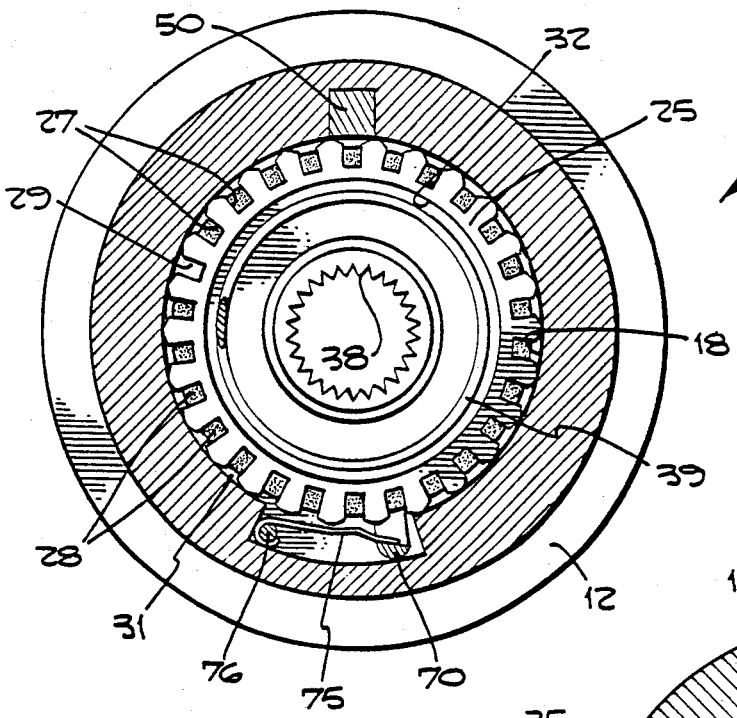
FIG. 9 is a cross-sectional view on the line 9—9 of FIG. 7 in the direction of the arrows 9—9.

As shown in FIGS. 4 and 9, the locking discs are provided with a set of circumferentially spaced slot spaces 27 numbering twenty-six in the chosen embodiment. All but one of the slot spaces are substantially filled with a filler material 28 which may, for example, be an approximately compounded synthetic plastic resin, cable of being removed when occasion requires. A single slot space 29 serving as a release slot is left clear and may be appropriately identified as a gate. Relief depressions 31 are provided at outer ends of all the slot spaces except the slot 29, one purpose of which is to reduce the area of contact of the outermost circumference of the locking discs 25 with the wall of the chamber 18, thereby to minimize frictional engagement during operation.

Figure 5:
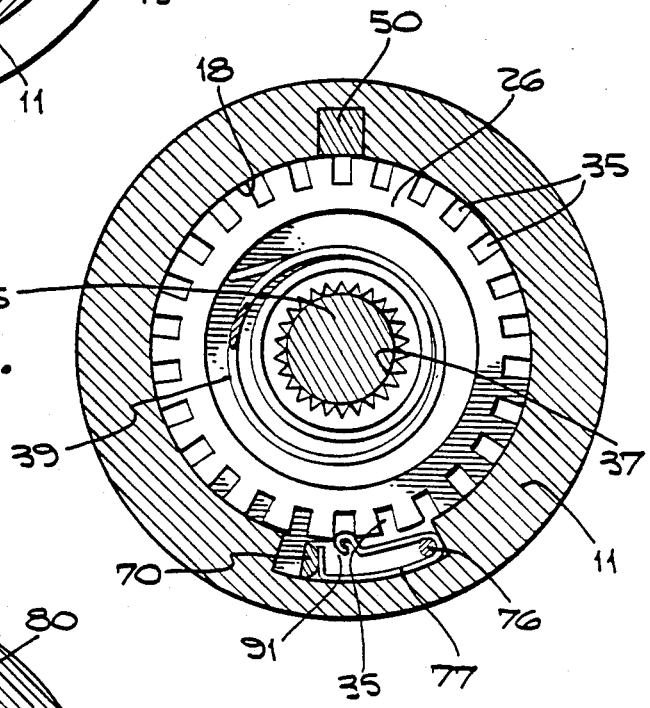
FIG. 5 is a cross-sectional view of the line 5—5 of FIG. 2 in the direction of the arrows 5—5.
Figure 10:
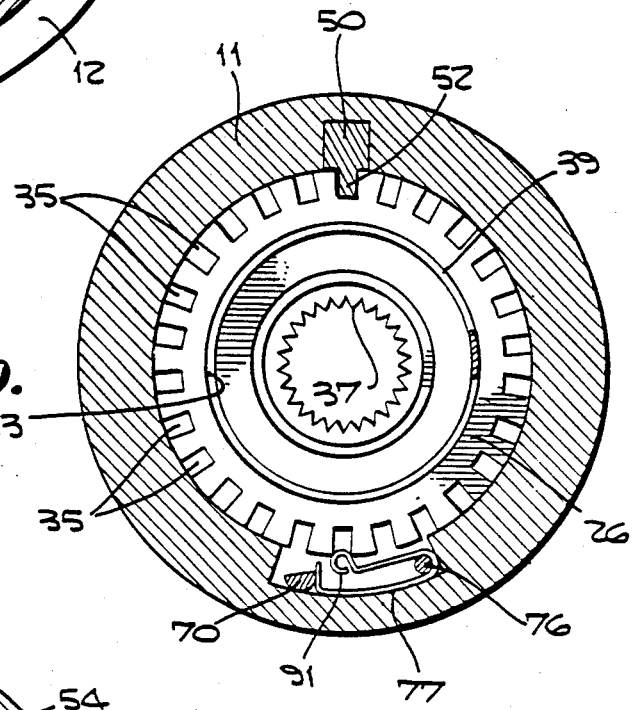
FIG. 10 is a cross-sectional view on the line 10—10 of FIG. 7 in the direction of the arrows 10—10.

The combination disc 26 of each pair, as shown advantageously in FIGS. 5 and 10, is provided with a multiple number of circumferentially spaced combination slots 35, likewise numbering 26 in all in the chosen embodiment, to correspond to the combination characters, namely, the letters of the alphabet. There is a serrated central bore 37 which is complementary with respect to the serrated collar 17 of the key 14. There is a comparable serrated central bore 38 for the locking disc 25.

Figure 12:
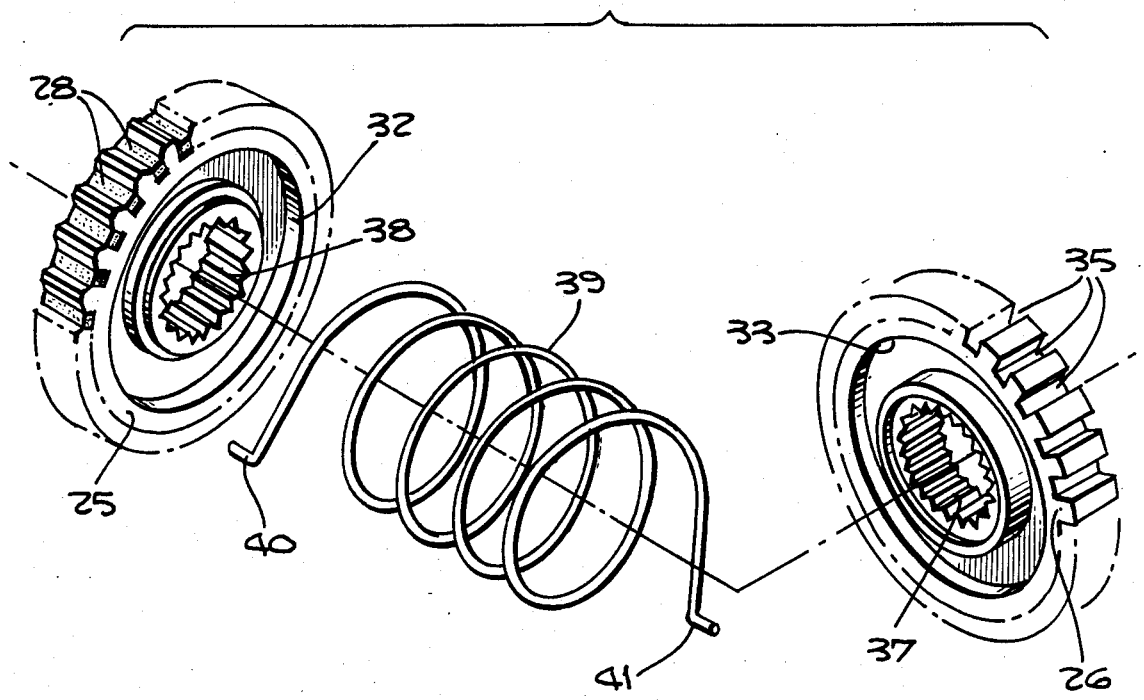
FIG. 12 is a exploded perspective view of a pair of discs and spring return.
Figure 7:
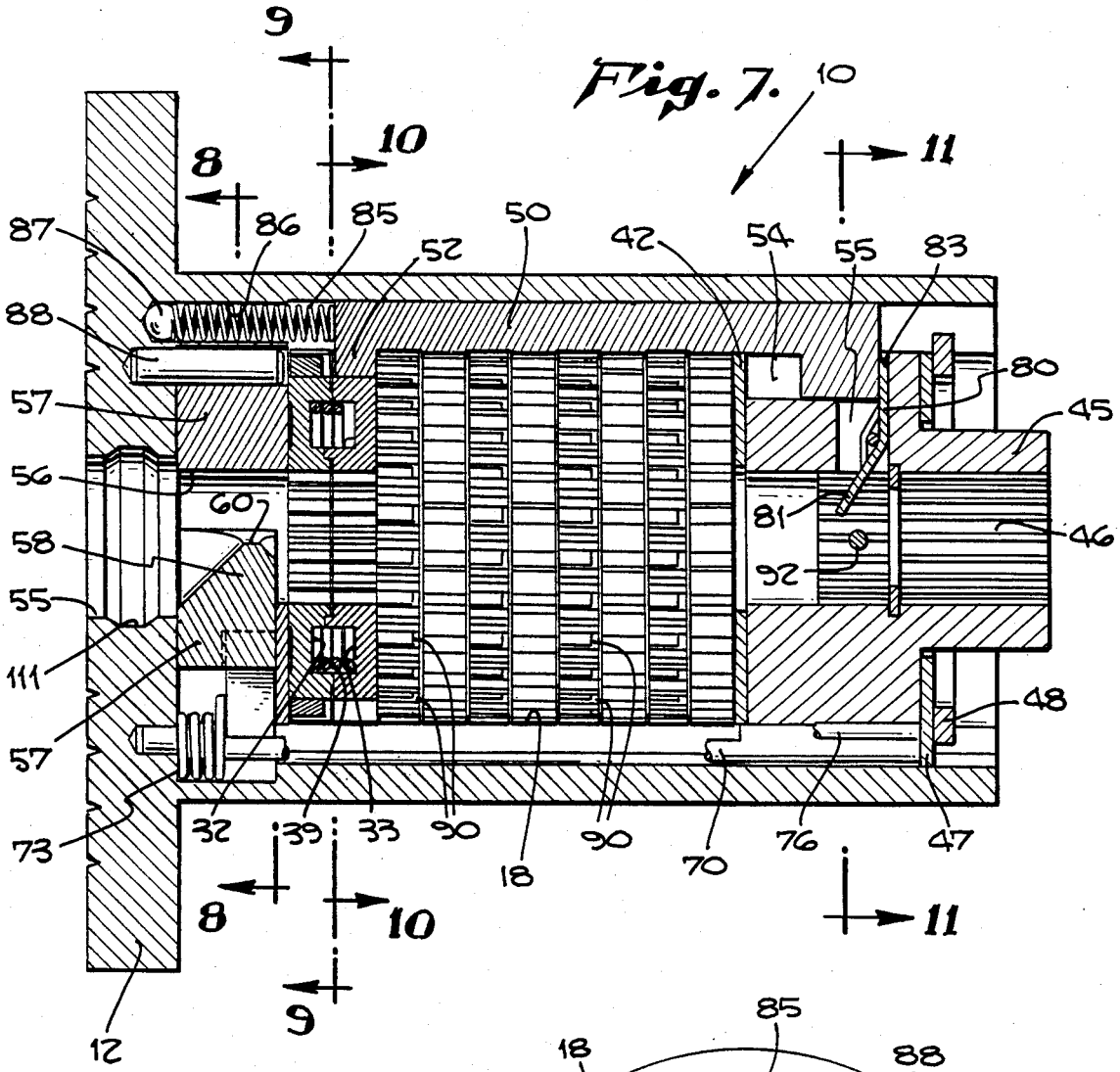
FIG. 7 is a longitudinal sectional view similar to FIG. 1 but with the key removed.

Acting between the locking disc 25 and combination disc 26 is a torsion spring 39, see FIG. 12, one end 40 of which is attached in a conventional fashion to the locking disc 25 and the other end 41 of which is attached in a comparable fashion to the combination disc 26. A recess 32 in the locking disc 25 with a recess 33 in the combination disc 26 accommodates the spring 39. The torsion spring acts in a manner such as to return the discs to an initial relationship after they have been moved during the course of operation and subsequently released. Stacked, as shown in FIGS. 2 and 7, the pairs of discs bear at the inside end against a thrust washer and rod bearing plate 42 and are retained at the opposite end by a washer 43.

The ultimate objective of the combination lock is to rotate an operating plug 45 which is located at what may appropriately be identified as a lock operating inner end of the device. The plug 45 is one for unlocking and locking an appropriate conventional lock operating mechanism of whatever the type may be to which the combination lock is applied. A serrated central bore 46 may be used for this purpose, or attachment otherwise to the plug 45. For holding the operating plug 25 rotatably in position within the chamber 18, there is provided a thrust washer 47 held in place by a retaining ring 48.

Figure 6:
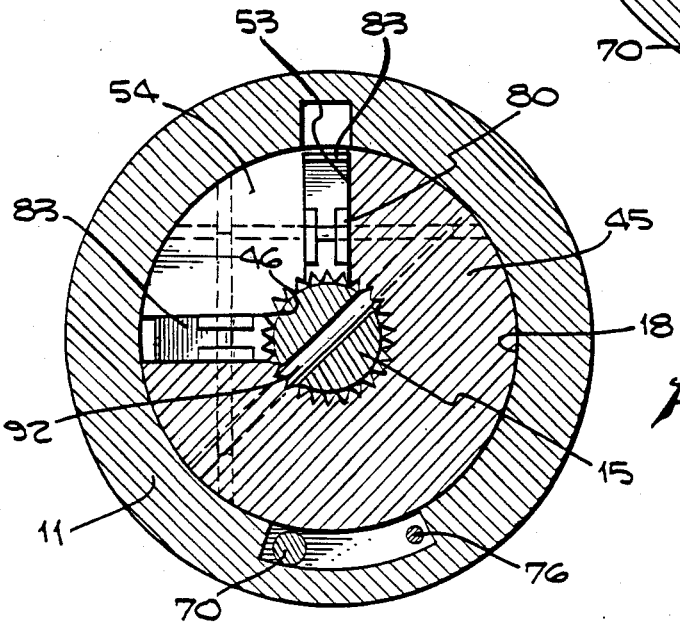
FIG. 6 is a cross-sectional view on the line 6—6 of FIG. 2.
Figure 11:
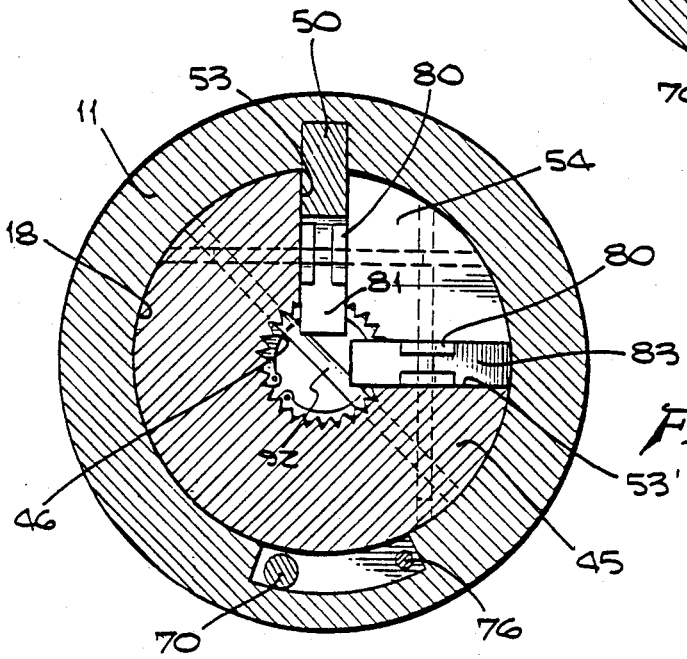
FIG. 11 is a cross-sectional view on the line 11—11 of FIG. 7.

Initially blocking rotation of the operating plug 45 is a slide bar 50. The blocking position is that of FIGS. 7 and 11. On the slide bar 50 at the end adjacent the operating plug 45 is a projection 51 which serves as a blocker. There are five additional longitudinally spaced projections or blockers 52, one for each of the pairs 20, 21, 22, 23 and 24 of discs. In blocking position the blocker 51 is confined within a blocking recess 53 in the plug 45. When the blocker is confined within the recess, the plug 45 cannot be rotated. Consequently, to rotate the operating plug the combination setting of the discs must first be decoded in order to release the slide bar so that it can be shifted out of the blocking recess 53 and into the area 54, FIGS. 6 and 11, which permits a 90-degree rotation of the plug.

Figure 8:
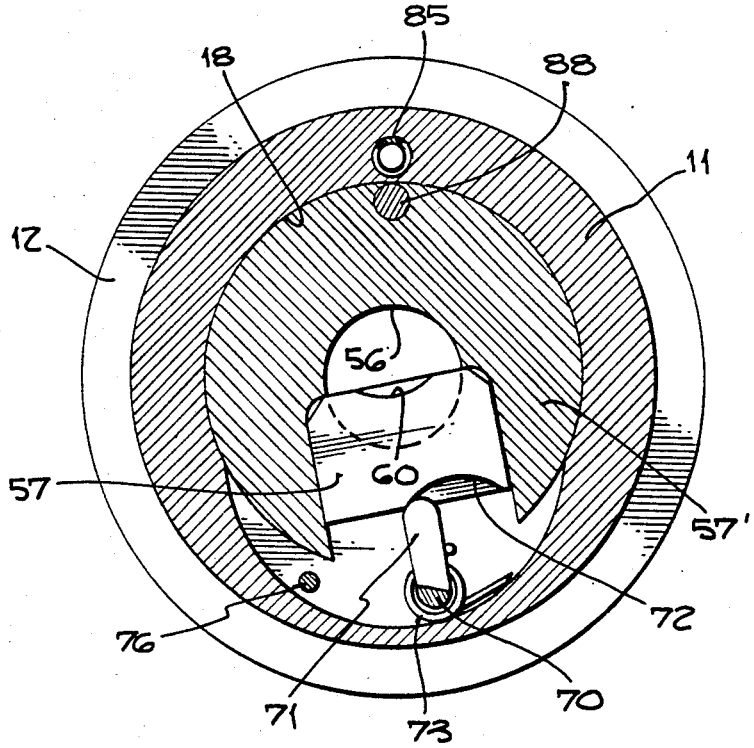
FIG. 8 is a cross-sectional view on the line 8—8 of FIG. 7.

To accomplish the decoding operation, the key 14 is initially inserted into a key hole 55 in the mounting ring 12 and then through a central opening 56 in an activator slide plate 57 slidably retained in a mounting plate 57'. Upon entering the central opening 56, the key strikes a cam track 58 which causes the activator slide plate to shift from the position of FIGS. 7 and 8 to the position of FIGS. 2 and 3. The key 14 is inserted only far enough to have the first detent groove 59 stopped in a position determined by engagement of the detent groove with a detent ridge 60 on the activator slide plate 57. The detent groove 59 is positioned to accommodate the outermost pair of discs 20. Additional detent grooves 61, 62, 63 and 64 in spaced positions along the cylindrical shaft 15 successively accommodate the pairs 21, 22, 23 and 24 of discs. In the first described position the serrations of the collar 17 engage the serrations 35 of the locking disc 25 of the first pair of discs 20.

The foregoing operation having been accomplished, the key 14 is rotated until an index marker 65 on the handle 16 is positioned opposite the first character of a five-character combination. This will be in the chosen embodiment one of the letters of the alphabet. Rotation of the locking disc 25 as described shifts the position of the open single slot space 29 from a random position, such as that of FIG. 9, to a decoded position, such as that of FIG. 4. During this same initial phase of the decoding operation, additional mechanisms are actuated.

Rotation of a tensioner rod 70 is motivated by the diametrical shift in position of the activator slide plate 57. An arm 71 of the tensioner rod, actually a bent portion of the rod, is rotated by action of an arcuate camway 72 so as to be moved clockwise from the position of FIG. 8 to the position of FIG. 3. Movement as described builds tension in a torsion spring 73. At the same time a camming flat on the tensioner rod 70 cams against a flexible braking shoe 75, shifting it from the release position of FIG. 9 to the braking position of FIG. 4 where a braking effect is applied to the lock disc 25. This braking effect occurs simultaneously for the lock discs of each of the pairs 20 through 24, inclusive, of the discs. There is a locating rod 76 for the captive end of each flexible braking shoe for the respective pairs. The braking effect thus provided assures that once the locking disc of each successive pair has been rotated to decoding position, it will not be disturbed from that position as decoding proceeds for the remaining of the five locking discs.

The tensioner rod incidentally serves also as a means of positioning and applying tension to an indexing arm 77, also established in its position by action of the locating rod 76.

After the locking disc 25 of the first pair 20 of discs has been rotated to the decoding position, the key is pushed into the housing one step further, namely, until the detent groove 61 engages the detent ridge 60. The position of the detent groove 61 is established at a location so that the serrations of the serrated collar 17 in that position will engage only the serrations of the serrated central bore 37 of the locking disc of the pair 21. Thus engaged, when the key 14 is rotated by the head or handle 16 so that the index mark 65 falls opposite the appropriate letter or character, second in the five-character combination, the single slot space, actually a release space of the locking disc of the second pair 21, comes into position in alignment with the slide bar 50 and corresponding projection or blocker 51. This having been accomplished, the shaft 15 of the key is then pushed further into the housing until the detent grooves 62, 63 and 64 are successively moved into position for rotating the locking disc 25 of the succeeding pairs 22, 23, and 24.

After the decoding position of the pair 24 has been accomplished, the shaft 15 is then free to be pushed inwardly a further distance sufficient to have the serrations of the collar 17 engage the serrated central bore 46 of the plug 45. The same final thrust of the shaft 15 actuates a slide bar activator 80 by shifting the position of an arm 81 from the position of FIG. 7 to the position of FIG. 2. As the activator 80 rotates about a pivot pin 82, the other arm 83 of the activator is moved against the adjacent end of the slide bar 50, shifting it endwise from the position of FIG. 7 to the position of FIG. 2. This has become possible because in decoding position of all of the pairs of discs all of the single slot spaces 29 will be in alignment with the slide bar 50 and its blockers 51. At this stage of operation the operating plug 45 is free to be rotated by rotation of the key between locked and unlocked positions. That is to say, if the plug is in position for locking the conventional lock to which it has been assigned, the lock can be unlocked. Conversely, if the plug is in position unlocking the mechanism, it can then be rotated to locked position.

The locking or unlocking rotation of the plug 45, as the case may be, having been accomplished, the key 14 can then be removed. The shaft 15 is then slid out of all of the serrated central bores 37 and 38 which have been serving together in the nature of a keyway, as well as being withdrawn from engagement with the plug 45. Once the key has been withdrawn, the activator slide plate 57 is freed and is returned to its initial position by action of the torsion spring 73. Also, as the tensioner rod 70 is rotated by torsion spring action to its initial position, tension on the flexible braking shoes 75 for each of the locking discs is released and the corresponding locking discs are free for rotation back to scrambled position with respect to the combination disc 26. This last counter-rotation of discs is accomplished by energy previously built up in the torsion spring 39. Before the discs can be rotated as just described, the slide bar must be and is returned from the position of FIG. 2 to the position of FIG. 7. This is accomplished by return action of a slide bar return spring 85 in an appropriate hole 86, and seated against a ball 87.

Although not serving as a functional part of the locking device, the security of the device is materially improved by provision of a pin 88 lodged in an appropriate pin recess 89 in the body, the pin being in alignment with the blockers 51 of the slide bar 50. Provision of such a pin located as described inhibits activity of an unauthorized person drilling into the lock device for the purpose of releasing the slide bar from its position blocking rotation of the plug 45.

The security of the device as a whole is further improved by locating the filler material 28 in the slot spaces 27 in a fashion to provide recesses 90 at the ends of the slot spaces facing inwardly in alignment, as noted, with the respective blockers 51 of the slide bar 50. By providing such recesses, should an unauthorized person devise a tool capable of manipulating the slide bar activator 80 without use of the required key, the blockers would lodge in recesses of the locking discs, thus preventing rotation of the locking discs in any event and prohibit accordingly rotation of the locking discs to positions where the single slot spaces acting as release slots would allow movement of the slide bar out of engagement with the plug 45.

Another advantage inherent in the locking device described herein is the ability to change the combination by manipulation of a key of the character of the key 14, manipulated from the outside, and without need to in any way dismantle any portion of the housing. Such a change in the combination is possible only by having prior knowledge of the applicable combination and while the discs are in decoded position. Recoding of the pairs of discs proceeds in reverse order to that employed during decoding, recoding of the pair 24 taking place first, followed by the recoding of such others of the pairs as may be changed. Any one or all of the pairs of discs may be recoded in a given operation.

On an occasion when it may be desired to change the decoding for the centermost pair 22 of the discs, the operation starts by decoding all five discs as would be done for releasing the plug 45, at which point the slide bar 50 has been released from locked position, as previously described. Between locked and unlocked positions the blockers 51 will be out of engagement with all of the combination discs 26, leaving them free for rotation. The key 14 is then moved outwardly to the position where the detent groove 62 is engaged by the detent ridge 60. In that position the serrated collar 17 would be, and is, in engagement with the serrated central bore 37 of the locking disc 25 of the pair 22. Since it is the combination disc 26 which is to be rotated to a new position, the shank 15 is then shifted inwardly from the position just described a distance only sufficient to disengage the collar 17 from the serrated central bore 37 to a position of engagement with the serrated central bore 38 of the combination disc 26 of that pair. So that it may be understood that the slide bar 50 will remain in released position where the blockers 51 are disengaged from the combination discs 26, despite urging of the spring 85, attention is directed to the 90-degree area 54, see FIG. 6. As a result, when the plug 45 is in a position of rotation wherein any portion of the area 54 abuts the right-hand end of the slide bar 50, see FIGS. 2 and 6, the slide bar remains in that fixed position. In that position any one or all of the combination discs 26 can be rotated by engagement with it of the collar 17 of the key 14. The blockers 51 are between the locked and unlocked positions when they are within the area 54. The operation is equally effective for recoding of any or all of the pairs 20 through 24 of discs.

For the recoding operation, the key is applied to the appropriate pair of discs with the pointer in line, with the old decode combination mark. The key is then rotated, either clockwise or counterclockwise, as viewed in FIG. 5, to the new recode position which will be represented by whatever letter of the alphabet corresponds to the new position. Should rotation in one direction be blocked, before the new position is reached it is necessary only to reverse the direction of rotation until the new position is reached by the reversal approach. The key 14 will then be withdrawn and thereafter the lock device can only be opened by employing the new combination for decoding represented by the change in coding of the pair 22. Should it be desired to change the decoding relationship of others of the pairs of discs, the locking discs of the appropriate pairs are changed in the same manner as has just been described for those other pairs.

To add still further to the degree of security built into the combination type locking device of the kind described, there may be provided in the plug 46 a cross pin 92 in that part of the serrated central bore 46 of the plug 45 which is engaged by the collar 17 of the key. When this expedient is to be employed, the free end of the shank 15 of the key need be provided with a notch 93, the sides of which are yieldable in order to enable an enlarged portion 94 of the notch to engage the cross pin 92 in the position of rotation of the shank which accommodates the cross pin. Properly positioned the shank can be pushed into the serrated central bore 46 far enough to engage the plug 45 and rotate it. Whatever may be the last described position, it will be a position other than that corresponding to the decoding character for the innermost pair 24 of discs. Accordingly, an unauthorized observer would not be able to determine the correct decoding position of one-fifth of the number of discs and therefore would be forced to, in effect, dicipher the entire combination before gaining inadvertent admittance to the decoding characteristics of the lock device.

For greater ease and precision in operation of the locking device, whether for decoding or for recoding, a specially constructed key member 100 may be employed instead of the key 14 heretofore disclosed. The specially constructed key member of FIG. 13 and related figures consists of an outer sleeve 101, an inner sleeve 102, and a core 103 concentrically disposed. The outer sleeve is essentially a jacket within which the other parts are contained and being provided with knurled grooves 104 serves as a handle for key operation. The inner sleeve 102, slidably mounted within the outer sleeve 101, includes a springkeeper plate 105 on which a spring 106 is bottomed. An end plug 107 of the outer sleeve 101 is pinned in place by a pin 108, closing the outer end of a spring chamber 109.

Of functional consequence is the provision of a group of resilient splines 110 at the right-hand or outer end of the inner sleeve. The splines are adapted to be lodged in an annular interior recess 111 within the keyhold 55' in the mounting ring 12' (see FIG. 15).

In the wall of the inner sleeve 102 is a slot 113 within which a resilient lip 112 is adapted to reciprocate in a functional capacity.

A clip 115 is in fact a multiple purpose convenience clip pivotally secured as shown by means of a pin 116 in an opening 117 in the wall of the outer sleeve 101.

The core 103 has a shape and function comparable to that of the cylindrical shaft 15 of the key 14 previously described. At the exposed outer end of the core is a serrated collar 118. Immediately adjacent the collar 118 is a notch 93' providing an enlarged portion 94'. The core is additionally provided with a series of longitudinally spaced detent grooves 119, 120, 121, 122 and 123, which suffices for a locking device having five pairs of discs. Additional grooves 124, 125 are provided for related functions.

For cooperation with the detent grooves there is provided a pointer 127 partially contained with a slot 128 in the outer sleeve 101 and pivotally contained within a slot 129 of the inner sleeve 102 by means of a pin 130.

For cooperation with the pointer, the core 103 is provided with a progression of transversely disposed bars 131, 132, 133 and 134 within an elongated slot 135 of the core at stepped locations. A notch 136 in an extension 137 of the pointer 127 is adapted to successively engage the bars 131–134.

Figure 13:
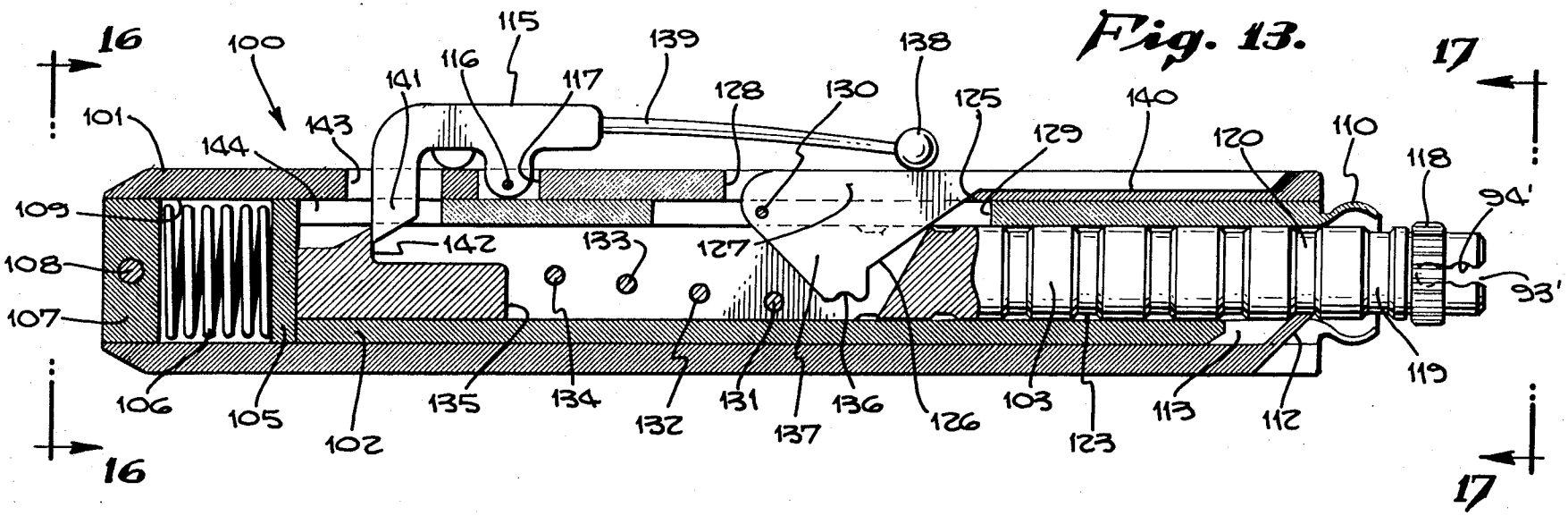
FIG. 13 is a longitudinal sectional view of a modified key member in a position at rest.

In a position of at rest, as in FIG. 13, a ball 138 at the end of a resilient shaft 139 of the clip 115 is adapted to bear against the pointer 127 and hold it snugly within a recess 140 of the exterior sleeve 101. At the same time, a footpiece 141 at the opposite end of the clip 115 engages a stop 142, actually a portion of the core 103 at the inside end of the elongated slot 135. Aligned openings 143 and 144, respectively, in the outer sleeve and inner sleeve freely accommodate the footpiece 141. In the at rest position of FIG. 13, the clip 115 additionally serves as a means for releasably holding the core 103 within the outer and inner sleeves. By holding the core as described, the core in turn serves to hold the inner sleeve within the outer sleeve.

Figure 14:
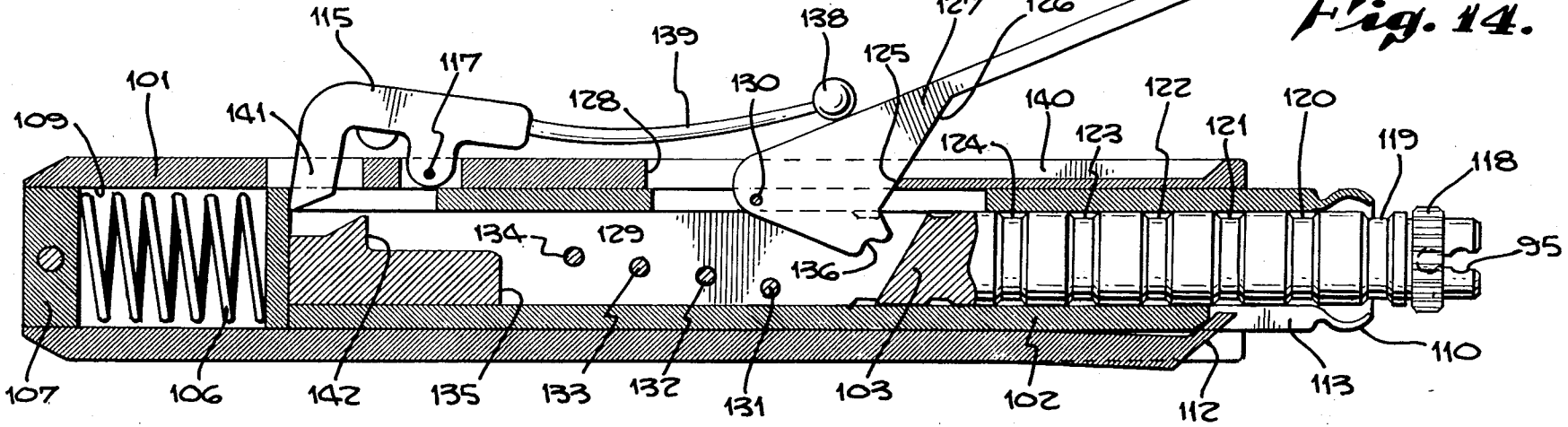
FIG. 14 is a longitudinal sectional view similar to FIG. 13 with the inner key and core extended.

The core can be released for operation by depressing the shaft 139 midway between opposite ends an amount sufficient to dislodge the footpiece 141 from the stop 142, at which point the spring 106 can be depended upon to shift the stop 142 in a direction from left to right, as viewed in FIG. 13, clearing the way for further operative extension of the inner sleeve beyond the outer sleeve to the position of FIG. 14.

For a decoding operation once the core 103 has been released, the core is then pushed through the keyhole 55 until the collar 118 lodges non-rotatably within the locking disc 25 of the pair 20 of discs. Operation as described also brings the splines 110 into the keyhole where they are lodged in the annular recess 111. Pressing against the end plug 107 serves to move the right end of the outer sleeve 101 into engagement with the mounting ring 12'. At the same time the resilient lip 112 is projected into the detent groove 121. In this position the pointer is tilted so that its free end coincides with and points to an arcuate marker 150 on the face of the mounting ring 12'. Additional arcuate markers 151, 152 and 153 are associated, respectively, with the pairs 21, 22 and 23 of the discs, the pair 24 being associated with the arcuately disposed ring 154 formed by the letters of the alphabet. The decoding step for the pair 20 of discs is then performed by rotation of the key member 100 until the end of the pointer points to the appropriate letter.

After the decoding step for the pair 20 of discs has been accomplished, at which time the detent groove 119 engaged the detent ridge 60, the core 103 is then extended until the detent groove 120 is in a position to potentially engage the detent ridge 60. Expansion of the previously contracted spring 106 moves the outer sleeve 101 from right to left a distance equal to the distance from one detent groove to the next. As the outer sleeve moves a camming edge 125 moves against a cam face 126 on the pointer 127, shifting the free end of the pointer to a position adjacent the arcuate marker 151 for the next pair of discs. By again pressing on the end plug 107, the outer sleeve is moved toward the mounting ring 12' an equal distance and the resilient lip 112, then in engagement with the detent groove 121, moves the core 103 to a position where the collar 118 engages the locking disc 25 of the next pair 21 of discs. Movement of the core to that position shifts the transverse bar 132 into a position of engagement with the notch 136 of the pointer. As a consequence, when the key member 110 is inserted into the locking device to a position where the collar 118 engages the locking disc 25 of the next adjacent pair 21 of discs and the splines 110 have been lodged as described in the annular recess 111, the end of the pointer will be at the arcuate marker 151, precisely indicating that it is the pair 21 of discs which are to be decoded by appropriate rotation of the key member 100. Decoding of the pairs 22, 23 and 24 is accomplished in a comparable fashion. On each occasion the pointer 115 will shift to the corresponding arcuate marker to precisely indicate which of the pairs of discs the key member is in a position for decoding.

After the rightmost pair 24 of discs has been decoded, the slide bar 50 is released in the manner heretofore described so that the operating plug 45 is free for rotation. To successfully rotate the operating plug, however, the key member must be shifted from the last decoding position to a position wherein the notch 93' is in alignment with the cross pin 92 of the operating plug. The key member can then be rotated, clockwise or counterclockwise, as the case may be, rotating the operating plug 45 in a comparable direction for the appropriate unlocking or locking operation.

On those occasions where the key member 100 is to be used for recoding, it is advantageous to rotate the key member first to a position part way through the operating cycle in order to have the slide bar remain in a position engaging all of the pairs of discs. The key member 100 is then withdrawn from the key hole and the collar 118 is shifted toward the end of the key member for a distance equal approximately to the thickness of one of the discs. The key member is then applied to the locking device to a position of engagement preferably with the first pair 20 of locking discs. For this and each succeeding setting the collar will engage the combination disc of the pair rather than the locking disc, with the pointer 115 continuing to precisely and visibly reveal which pair of discs is being engaged. Recoding then proceeds in the same manner as has been heretofore described.

When the recoding has been accomplished, the operating plug is rotated, clockwise or counterclockwise, as the case may be, to the endmost position of rotation, at which time the key member may be withdrawn and the locking bar will be shifted to initial position blocking further rotation of the operating plug.

In addition to the numerous security features built into the key combination lock as already described and shown in the drawings, there is a still further inherent advantage for certain types of high security installations. As a consequence of utilizing a key for the decoding operation, the lock itself can be mounted securely adjacent the inside face of a door of virtually any feasible thickness or type of material. To operate a lock on the inside of an exceptionally thick door, it is necessary only to have a key with a special lower shaft like the shaft 15 of the key of FIG. 1, the remaining portions of the key being built the same as already described. The shaft need be made only long enough to span the thickness of the door. With the set 13 of combination characters only of the lock placed on the outside face of the door around the keyhole, the lock cannot be readily tampered with. Should the door, for example, be of stone and concrete, tampering even by an explosive charge would be difficult.

Figure 15:
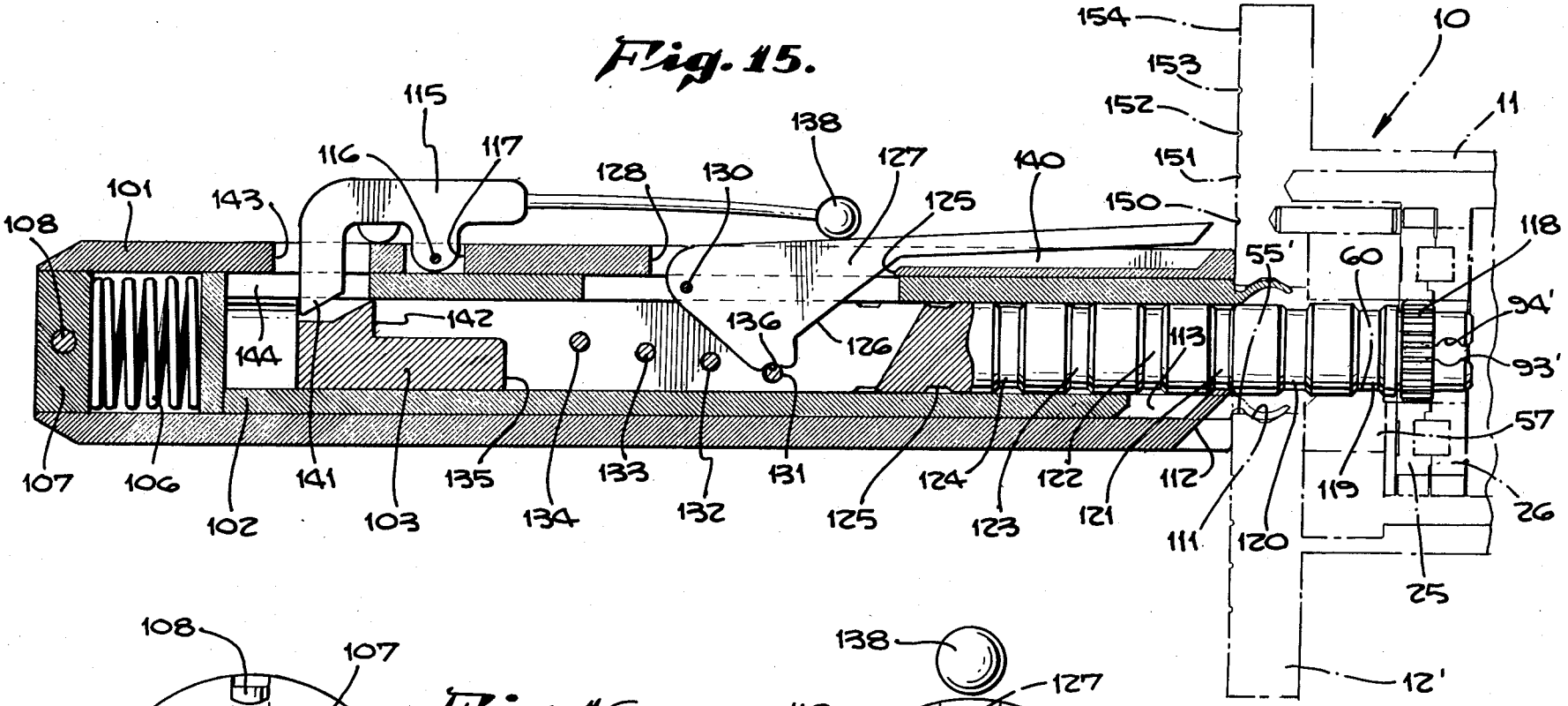
FIG. 15 is a longitudinal sectional view similar to FIG. 13 with the key engaged with the lock device.
Figure 17:
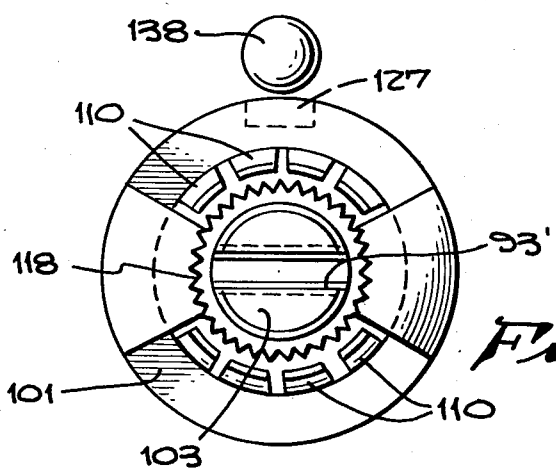
FIG. 17 is a right end elevational view on the line 17—17 of FIG. 13.
Figure 16:
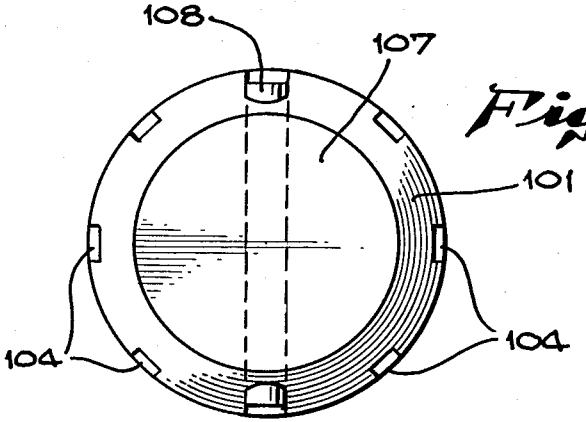
FIG. 16 is a left end elevational view on the line 16—16 of FIG. 13.

The long shaft advantages attributable to the key 14 of FIG. 1 are also inherent in a key like that of FIGS. 14, 15 and 16 where a comparable longer shaft with inner and outer sleeves may also be made use of.

While a particular embodiment of the present invention has been shown and described, it will be obvious to those skilled in the art that changes and modifications may be mde without departing from the invention in its broader aspects and, therefore, the aims of its appended claims are to cover all such changes and modifications as fall within the true spirit and scope of this invention.

Having described the invention, what is claimed as new in support of Letters Patent is as follows:

1. A combination type locking device for operation with a key member, said device comprising a substantially cylindrical housing having a key access outer end and a lock operating inner end, a lock operating plug rotatably mounted in said housing at the inner end, a plurality of pairs of discs rotatably mounted in said housing intermediate the outer and inner ends, one disc of each pair being a combination disc and the other disc of each pair being a locking disc, said locking disc having a circumferentially disposed release slot and said combination disc having a plurality of circumferentially spaced combination slots, a longitudinally extending slide bar having a first position in rotation blocking engagement with said plug and a second position free of engagement with said plug, longitudinally spaced blockers on said slide bar having positions respectively in said combination slots when said slide bar is in said first position and having positions in said release slots when said slide bar is in said second position, said slide bar being shiftable from said first position to said second position when the release slot of each pair of discs has been rotated to decoding alignment with the respective blocker whereby to release said plug for lock operation.

2. A combination type locking device as in claim 1 wherein said locking discs comprise means subject to key member operation whereby to enable movement of said release slots to positions of alignment with the blockers of said slide bar.

3. A combination type locking device as in claim 1 wherein there is a return spring acting in a counter-rotational direction between the discs of each pair whereby to return said discs to original positions.

4. A combination type locking device as in claim 1 wherein there is a braking means normally in release adjustment and adapted to act between the housing on each respective lock disc during a decoding operation whereby to hold the release slot in decoding position during movement of successive pairs of discs to decoding position.

5. A combination type locking device as in claim 4 wherein there is a key member and a key responsive activator for said braking means subject to key operation adapted to activate said braking means and in the alternative to release said braking means in the absence of a key member.

6. A combination type locking device as in claim 5 wherein there is a resilient means acting between the housing and the activator adapted to release said brake means upon withdrawal of said key member.

7. A combination type locking device as in claim 5 wherein said brake means comprises a brake member for each pair of discs and a single brake transitioner rod in engagement with all said brake members.

8. A combination type locking device as in claim 1 wherein there is a key member comprising a rotatable shaft for engagement with and the decoding of said discs, temporary detent means at longitudinally spaced locations on the rotatable shaft corresponding to the respective pairs of discs.

9. A combination type locking device as in claim 1 wherein there is a key member comprising a rotatable shaft for engagement with and the decoding of said discs, an operating plug rotatably mounted in the housing and releasable keying means between said key member and said plug whereby to enable rotation of said plug by said key member upon the decoding of said pairs of discs.

10. A combination type locking device as in claim 1 wherein there are centrally disposed aligned openings in the respective discs forming a keyway, a slide bar activator adjacent said plug and responsive to operation by said key member, and a resilient return means acting between said housing and said slide bar whereby to return said slide bar to initial position upon disengagement of said key member from said keyway.

11. A combination type locking device as in claim 10 wherein said slide bar activator comprises a lever member having a pivot mounting on said housing, one arm of said lever being in the path of movement of said key member and responsive to movement of said key member, another arm of said lever being in the path of movement of said slide bar and having a driving engagement with said slide bar.

12. A combination type locking device as in claim 1 wherein there is a key member comprising a handle and a rotatable shaft on said handle, keying means on said shaft, and complementary keying means on the respective discs, said key member being movable to successive positions of engagement with respective discs whereby to rotate said discs to decoding positions.

13. A combination type locking device as in claim 12 wherein the keying means on said shaft is in non-rotatable keying engagement with a lock disc at each of said successive positions.

14. A combination type locking device as in claim 12 wherein the keying means on said shaft is in keying engagement with a combination disc at each of said successive positions whereby to rotate said combination discs to different decoding positions.

15. A combination type locking device as in claim 14 wherein the shaft of the key member is one having temporary detent means at longitudinally spaced locations corresponding to locations of the corresponding combination disc of the respective pairs of discs.

16. A combination type locking device as in claim 14 wherein the shaft of the key member is one having temporary detent means at longitudinally spaced locations corresponding to locations of the corresponding lock discs.

17. A combination type locking device as in claim 1 wherein the lock disc has a multiplicity of circumferentially spaced slots extending around the perimeter, and removable fillers in all but one of said slots whereby to provide a single open release slot.

18. A combination type locking device as in claim 1 wherein there is a depression at the end of each slot facing the blocker on the slide bar adapted to receive a portion of the blocker whereby to prevent rotation of the lock disc in the event of unauthorized displacement of said slide bar.

19. A combination type locking device as in claim 1 wherein there is a pin rotatably mounted in said housing in axial alignment with said blockers whereby to inhibit unauthorized release of said slide bar by a drilling operation.

20. A combination type locking device as in claim 1 wherein said lock disc of each pair has a plurality of circumferentially spaced slot spaces corresponding to respective slots in the combination disc and removable filler means in all but one of said slot spaces, said one of said slot spaces comprising the release slot.

* * * * *